US007974564B2

(12) United States Patent
Hamaba et al.

(10) Patent No.: US 7,974,564 B2
(45) Date of Patent: Jul. 5, 2011

(54) UNIT OPPOSING A FIXING DEVICE IN AN IMAGE FORMING APPARATUS

(75) Inventors: Keijirou Hamaba, Kanagawa (JP); Tomokazu Akuta, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 701 days.

(21) Appl. No.: 12/019,694

(22) Filed: Jan. 25, 2008

(65) Prior Publication Data

US 2008/0181684 A1 Jul. 31, 2008

(30) Foreign Application Priority Data

Jan. 31, 2007 (JP) ..... 2007-021525

(51) Int. Cl.
*G03G 15/20* (2006.01)

(52) U.S. Cl. ..... 399/336

(58) Field of Classification Search ..... 399/336, 399/337, 67, 68, 335
See application file for complete search history.

(56) References Cited

U.S. PATENT DOCUMENTS 3,197,614 A * 7/1965 Engelstad et al. ..... 219/388
4,265,198 A 5/1981 Shinohara et al.

FOREIGN PATENT DOCUMENTS

DE 9308981.3 U1 10/1993
GB 2241675 A 9/1991
JP 2002-62755 A 2/2002
WO 0157600 A1 8/2001

* cited by examiner

*Primary Examiner* — David M Gray
*Assistant Examiner* — Gregory H Curran
(74) *Attorney, Agent, or Firm* — Sughrue Mion, PLLC

(57) ABSTRACT

An image forming apparatus includes: a fixing device that causes a toner image to be fixed onto a recording medium; an opposing unit that is disposed opposing the fixing device and forms a conveyance path in between the fixing device, the recording medium being conveyable on the conveyance path; a holding member for the recording medium that is disposed at the opposing unit and positioned between the recording medium conveyed on the conveyance path and the fixing device; and a withdrawal mechanism that causes the opposing unit to be withdrawn in a direction away from the fixing device.

18 Claims, 7 Drawing Sheets

UNIT OPPOSING A FIXING DEVICE IN AN IMAGE FORMING APPARATUS

CROSS-REFERENCE TO RELATED APPLICATION

This application is based on and claims priority under 35 USC 119 from Japanese Patent Application No. 2007-21525 filed on Jan. 31, 2007.

BACKGROUND

1. Technical Field

The present invention relates to an image forming apparatus that causes a toner image to be fixed onto a recording medium.

2. Related Art

Image forming apparatus that form an image by an electrophotographic technique are configured to apply heat energy to a recording medium to which a toner image has been transferred and melt the toner to thereby cause the toner image to be fixed onto the recording medium. As techniques for causing the toner image to be fixed onto the recording medium, there is a technique that uses a heat roll to apply heat and pressure to the recording medium and a technique that uses a flash fixing device to irradiate the recording medium to which the toner image has been transferred with flash light from a flash lamp to cause the toner image to be fixed to the recording medium.

Usually, a flash fixing device is disposed with a fixing unit configured by a straight pipe-like flash lamp, a reflective plate that causes the light from the flash lamp to be reflected towards a conveyance surface of the recording medium, a box-like frame that houses the flash lamp and the reflective plate and opens towards the conveyance surface side of the recording medium, and a plate glass that covers the open surface of the frame.

SUMMARY

A first aspect of the present invention is an image forming apparatus including: a fixing device that causes a toner image to be fixed onto a recording medium; an opposing unit that is disposed opposing the fixing device and forms a conveyance path in between the fixing device, the recording medium being conveyable on the conveyance path; a holding member for the recording medium that is disposed at the opposing unit and positioned between the recording medium conveyed on the conveyance path and the fixing device; and a withdrawal mechanism that causes the opposing unit to be withdrawn in a direction away from the fixing device.

BRIEF DESCRIPTION OF THE DRAWINGS

Exemplary embodiments of the present invention will be described in detail based on the following figures, wherein.

DETAILED DESCRIPTION

Figure 1:
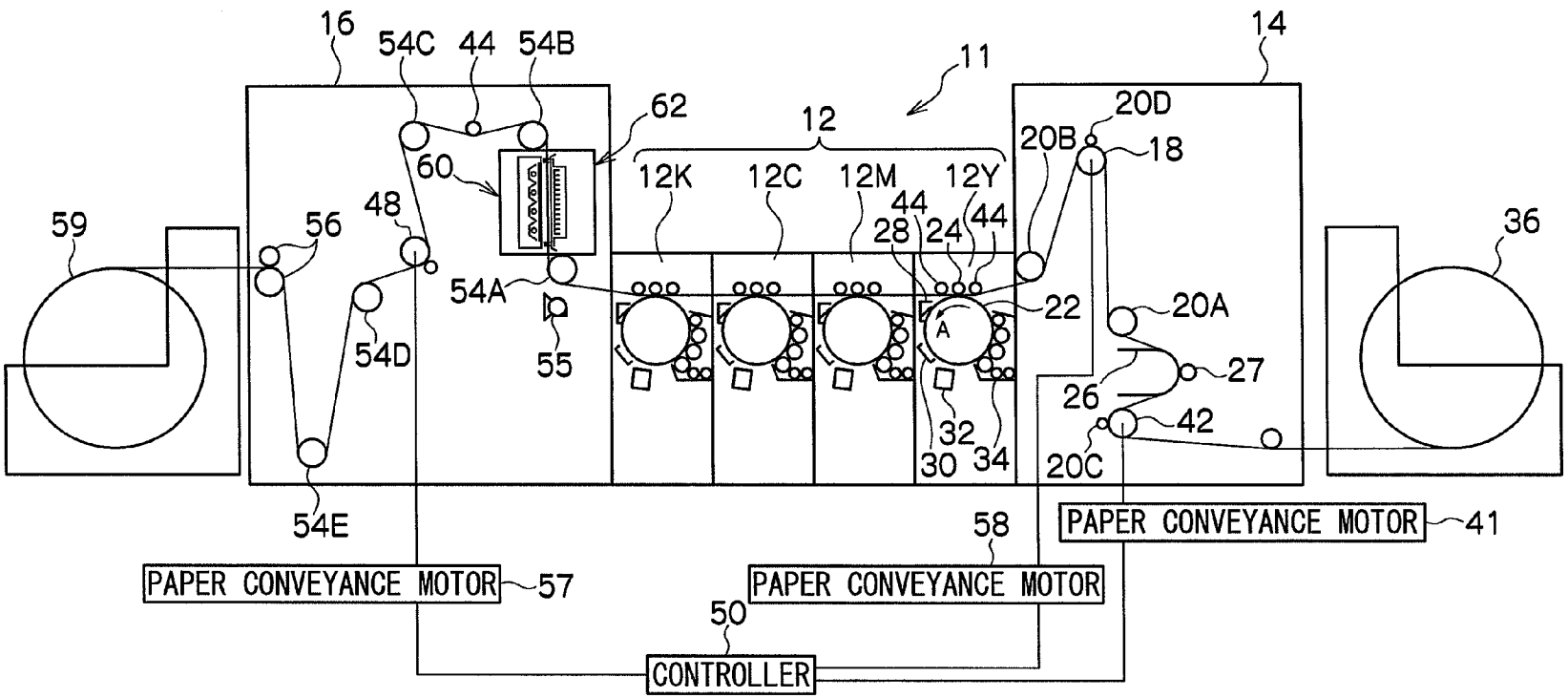
FIG. 1 is a general configural diagram showing an image forming apparatus pertaining to a first exemplary embodiment of the invention.

An image forming apparatus pertaining to a first exemplary embodiment of the present invention will be described below with reference to the drawings.

A color laser printer (called "printer" below) 10 serving as the image forming apparatus is disposed with an image forming section 11 that forms an image on continuous paper P serving as a recording medium. Printing units 12Y, 12M, 12C and 12K that sequentially transfer and superpose toner images of the respective colors of yellow (Y), magenta (M), cyan (C) and black (K) on the continuous paper P are disposed in the image forming section 11 in order from upstream in a conveyance direction of the continuous paper P.

It will be noted that when it is necessary to distinguish between Y, M, C and K, then the letters "Y", "M", "C" and "K" will be added behind the reference numerals, and when it is not necessary to distinguish between Y, M, C and K, then the letters "Y", "M", "C" and "K" will be omitted. Further, when just "conveyance direction" is used, this will refer to the conveyance direction of the continuous paper P.

Each of the printing units 12 is disposed with a photoconductor drum 12. A transfer roll 24, a cleaning device 28, a charger 30, an LED head 32 and a developing device 34 are disposed around each of the photoconductor drums 22 in order in a rotating direction (the direction of arrow A in FIG. 1) of the photoconductor drum 22.

The transfer roll 24 contacts the upper surface of the photoconductor drum 22, nips and conveys the continuous paper P between itself and the photoconductor drum 22, and causes a toner image formed on the photoconductor drum 22 by the developing device 34 to be transferred to the continuous paper P. Further, two guide rolls 40 are disposed upstream and downstream of the transfer roll 24.

The charger 30 charges the surface of the photoconductor drum 22, and the LED head 32 line-exposes the surface of the photoconductor drum 22 to form a latent image thereon. Additionally, the developing device 34 applies toner to the latent image formed on the photoconductor drum 22 to form a toner image. Further, the cleaning device 28 scrapes off and removes untransferred residual toner that remains on the surface of the photoconductor drum 22 without being transferred to the continuous paper P.

A paper conveyance section 14 that conveys the continuous paper P to the image forming section 11 is disposed upstream of the printing units 12 in the conveyance direction.

The paper conveyance section 14 is disposed with a main conveyance roll 18 around which is wrapped the continuous paper P supplied from a supply roll 36 disposed upstream of the paper conveyance section 14 in the conveyance direction.

A paper conveyance motor 58 that rotates on the basis of a pulse number sent from a controller 50 that controls the entire printer 10 is connected to the main conveyance roll 18, and the continuous paper P is conveyed while the feed amount thereof is controlled by the main conveyance roll 18.

An idle roll 20A and a back tension-applying roll 42 are disposed upstream of the main conveyance roll 18 in the conveyance direction, and an idle roll 20B is disposed downstream of the main conveyance roll 18 in the conveyance direction.

A paper conveyance motor 41 that rotates on the basis of a pulse number sent from the controller 50 is connected to the back tension-applying roll 42, and an idle roll 20C pressure-contacts the back tension-applying roll 42 so that the continuous paper P is nipped between and conveyed by the back tension-applying roll 42 and the idle roll 20C. Further, an idle roll 20D pressure-contacts the main conveyance roll 18, so that the continuous paper P is nipped between and conveyed by the main conveyance roll 18 and the idle roll 20D.

Thus, force is applied (back tension is applied) in the opposite direction of the conveyance direction to the continuous paper P by the back tension-applying roll 42, and tension is applied to the continuous paper P between the main conveyance roll 18 and the back tension-applying roll 42.

A conveyance guide 26 and an aligning roll 27 are disposed between the back tension-applying roll 42 and the idle roll 20A. Skew of the continuous paper P is corrected by the conveyance guide 26 and the aligning roll 27.

A fixing section 16 that causes the unfixed toner images transferred by the printing units 12 to be fixed to the continuous paper P is disposed downstream of the printing units 12 in the conveyance direction.

The fixing section 16 is disposed with a flash fixing unit 60 that performs fixing by heat radiated from xenon lamps or the like serving as a fixing device and an opposing unit 62 that is disposed opposing the flash fixing unit 60. Idle rolls 54A and 54B are disposed upstream and downstream of the flash fixing unit 60 and the opposing unit 62 in the conveyance direction. Details in regard to the flash fixing unit 60 and the opposing unit 62 will be described later.

An idle roll 54C is disposed downstream of the idle roll 54B in the conveyance direction, and a detection-use roll 44 serving as a slack detection unit is disposed between the idle roll 54B and the idle roll 54C.

The detection-use roll 44 is disposed inside (lower side in FIG. 1) a conveyance path of the continuous paper P in a state in which the continuous paper P is wrapped around the idle roll 54B and the idle roll 54C and stretched, and applies predetermined tension to the continuous paper P by its own weight and spring force.

Further, a shaft of the detection-use roll 44 is rotatably supported, in a state where it is movable up and down, on a frame of the fixing section 16, and the detection-use roll 44 is configured to move up and down depending on the amount of slack (strength of tension) in the continuous paper P.

Figure 2:
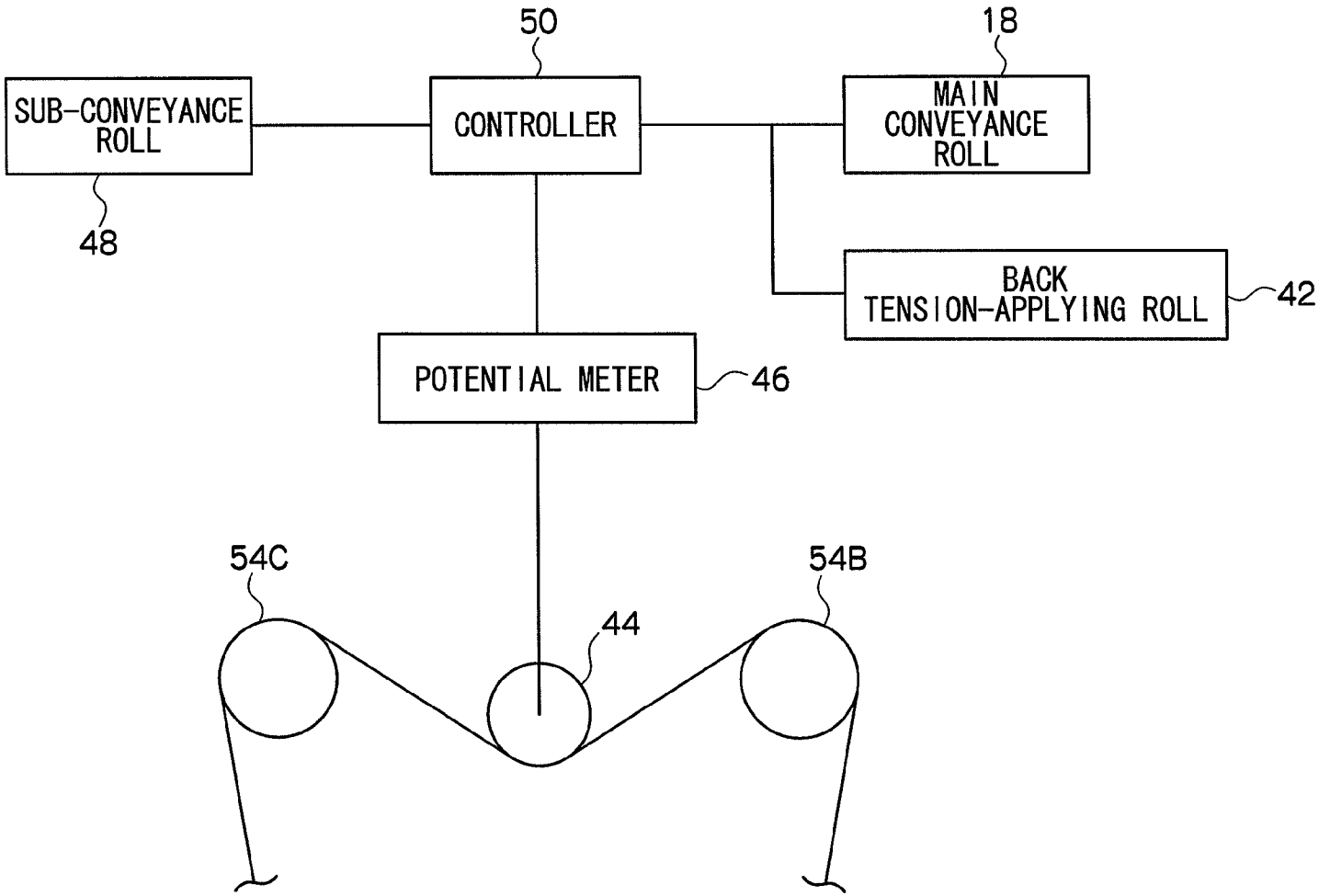
FIG. 2 is a schematic diagram showing the relationship between rolls of the image forming apparatus pertaining to the first exemplary embodiment of the invention and a potential meter connected to the rolls.

As shown in FIG. 2, a potential meter 46 whose voltage value is changed by the up and down motion of the detection-use roll 44 is attached to the detection-use roll 44. The potential meter 46 is connected to the controller 50, and the voltage value of the potential meter 46 is compared with a reference value such that which position (height) the detection-use roll 44 is in is judged.

For example, when the voltage value of the potential meter 46 is higher than the reference value, it is judged that the detection-use roll 44 is positioned lower than a predetermined position. In other words, the detection-use roll 44 is positioned lower than the predetermined position because the amount of slack in the continuous paper P is smaller than the reference value (because the tension is higher than standard). Further, when the voltage value of the potential meter 46 is lower than the reference value, it is judged that the detection-use roll 44 is positioned higher than the predetermined position. In other words, the detection-use roll 44 is positioned higher than the predetermined position because the amount of slack in the continuous paper P is larger than the reference value (because the tension is lower than standard).

Further, as shown in FIG. 1, a sub-conveyance roll 48 is disposed downstream of the idle roll 54C in the conveyance direction. A paper conveyance motor 57 that rotates on the basis of a pulse number sent from the controller 50 that controls the entire printer 10 is connected to the sub-conveyance roll 48 in the same manner as the aforementioned main conveyance roll 18, so that the continuous paper P is conveyed while the feed amount thereof is controlled by the sub-conveyance roll 48.

Idle rolls 54D and 54E are disposed downstream of the sub-conveyance roll 48 in the conveyance direction, and the continuous paper P is wrapped around the idle rolls 54D and 54E, guided to discharge rolls 56, and discharged from the fixing section 16. Then, the continuous paper P that has been discharged from the fixing section 16 is taken up on a take-up roll 59 disposed downstream of the fixing section 16 in the conveyance direction.

Next, the flash fixing unit 60 and the opposing unit 62 will be described.

Figure 3:
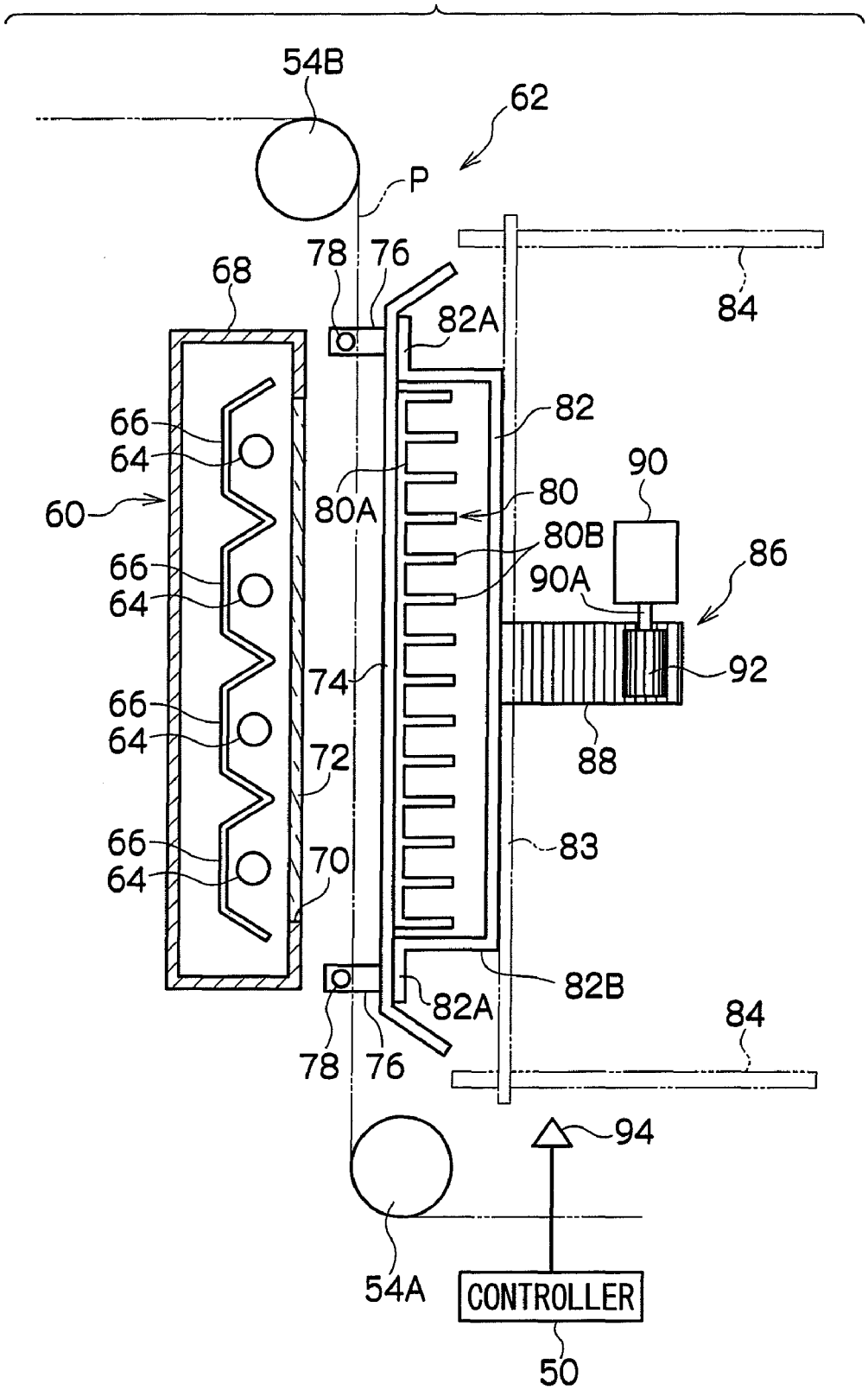
FIG. 3 is a side diagram showing a fixing device of the image forming apparatus pertaining to the first exemplary embodiment of the invention.

As shown in FIG. 3, the flash fixing unit 60 is disposed with flash lamps 64 that emit flash light for supplying light energy that causes the toner to be fixed (causes the toner to melt). In the present embodiment, four flash lamps 64 are disposed at predetermined intervals and such that their axial direction is in a direction intersecting the conveyance direction. It will be noted that although a configuration using four of the flash lamps 64 is described in the present embodiment, the number of the flash lamps 64 is not limited to four.

Disposed on the rear side (opposite side of the side facing the continuous paper P) of each of the flash lamps 64 is a reflective plate 66 that surrounds the rear side of the flash lamp 64 and in whose front side (side opposing the continuous paper P) an opening is formed. Flash light emitted from the flash lamps 64 towards the rear side is reflected by the reflective plates 66 towards the continuous paper P. It will be noted that although the flash fixing unit 60 has a configuration where a reflective plate 66 is disposed for each of the flash lamps 64 in the present embodiment, the flash fixing unit 60 may also have a configuration where four flash lamps 64 are surrounded by one reflective plate 66.

The flash lamps 64 are housed in a box-like frame 68. An open portion 70 is disposed in the side of the frame 68 opposing the continuous paper P, and a plate glass 72 is disposed in the open portion 70.

The opposing unit 62 is disposed opposing the flash fixing unit 60 on the printing surface side of the continuous paper P.

Figure 4:
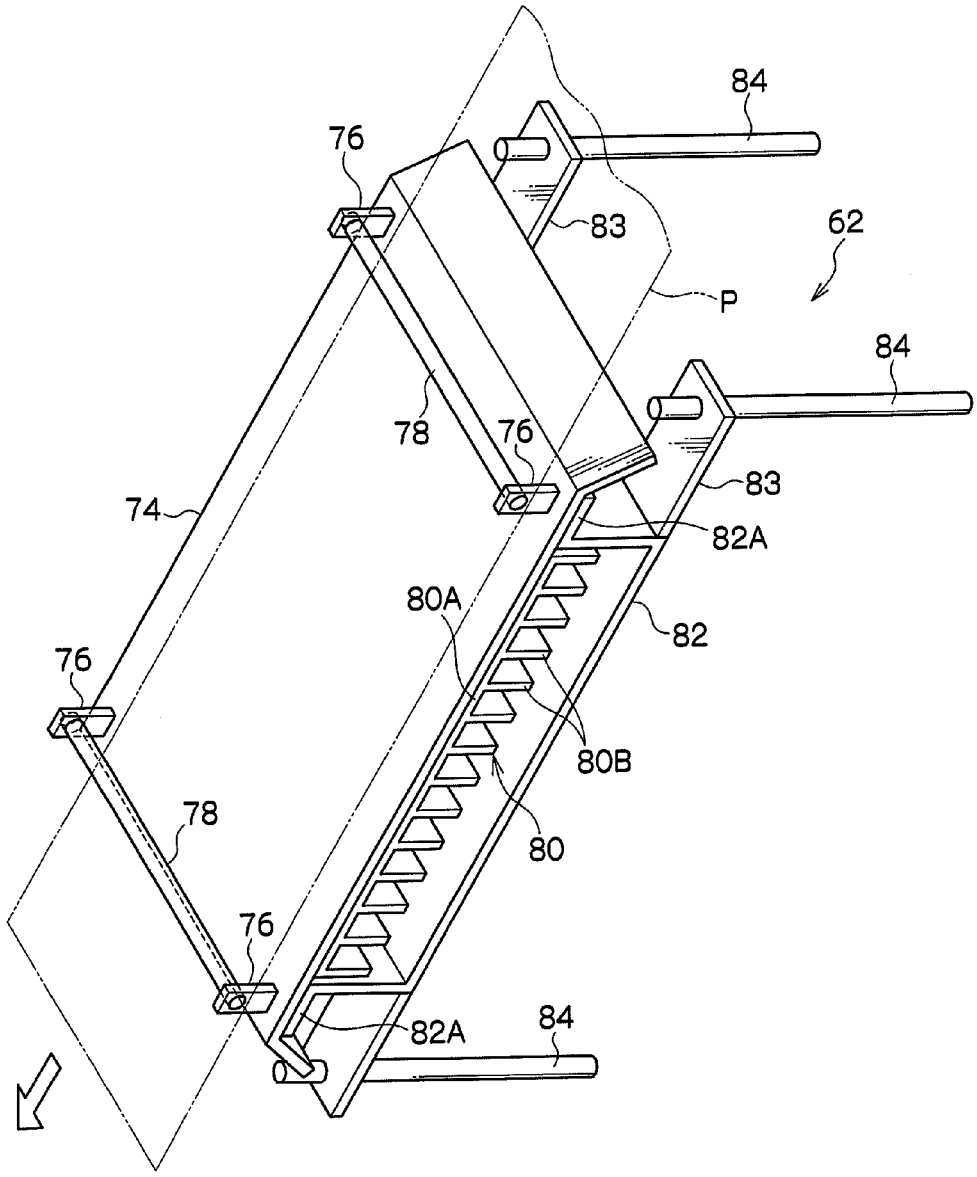
FIG. 4 is a perspective diagram showing part of the fixing device of the image forming apparatus pertaining to the first exemplary embodiment of the invention.

As shown in FIG. 3 and FIG. 4, the opposing unit 62 includes a guide plate 74 that contacts the surface on the opposite side of the printing surface of the continuous paper P. The guide plate 74 is configured in a plate shape of a slightly larger size than the plate glass 72, and circular column-shaped support members 76 are disposed on, so as to project from, the four corners of the surface of the guide plate 74 that faces the continuous paper P. Both longitudinal direction ends of roll-like guide members 78 (holding members) whose axial direction is in the width direction (direction intersecting the conveyance direction) are supported in a rotatable state in end portions of the support members 76.

In other words, the guide members 78 are supported by the support members 76 in positions a predetermined distance away from the guide plate 74 such that a clearance is formed between the guide members 78 and the guide plate 74. Additionally, the continuous paper P is inserted and conveyed through this clearance.

Further, heat radiating fins 80 are disposed on the back surface (surface on the opposite side of the surface that the continuous paper P contacts) of the guide plate 74. The heat radiating fins 80 are configured by a plate material 80A adhered and fixed to the back surface of the guide plate 74 and by long plate-like fins 80B disposed upright on the plate material 80A at predetermined intervals extending along the width direction.

Further, a housing 82 is disposed on the back surface of the guide plate 74 so as to enclose the heat radiating fins 80. Wing portions 82A are formed facing outward on both conveyance direction side walls of the housing 82. The wing portions 82A are screwed to the back surface of the guide plate 74, whereby the housing 82 is fixed to the back surface of the guide plate 74.

Long plate-like plate materials 83 are attached to the back surface of the housing 82 on both width direction (direction intersecting the conveyance direction) end portions, and both longitudinal direction ends of the plate materials 83 are movably supported on shafts 84. The shafts 84 are disposed such that their axes are substantially perpendicular with respect to the conveyance surface of the continuous paper P, and the housing 82 is configured to be movable along the shafts 84 in a direction substantially perpendicular with respect to the conveyance surface of the continuous paper P.

Further, a withdrawal mechanism 86 is disposed in the opposing unit 62. The withdrawal mechanism (evacuation mechanism) 86 includes a rack 88 that is attached to the rear surface (surface on the opposite side of the side facing the guide plate 74) of the housing 82, and a pinion 92 fixed to a rotating shaft 90A of a motor 90 meshes with the rack 88. Thus, when the pinion 92 is rotated by the rotational driving of the motor 90, the housing 82 moves via the rack 88 along the shafts 84 in directions towards or away from the flash fixing unit 60.

Figure 5B:
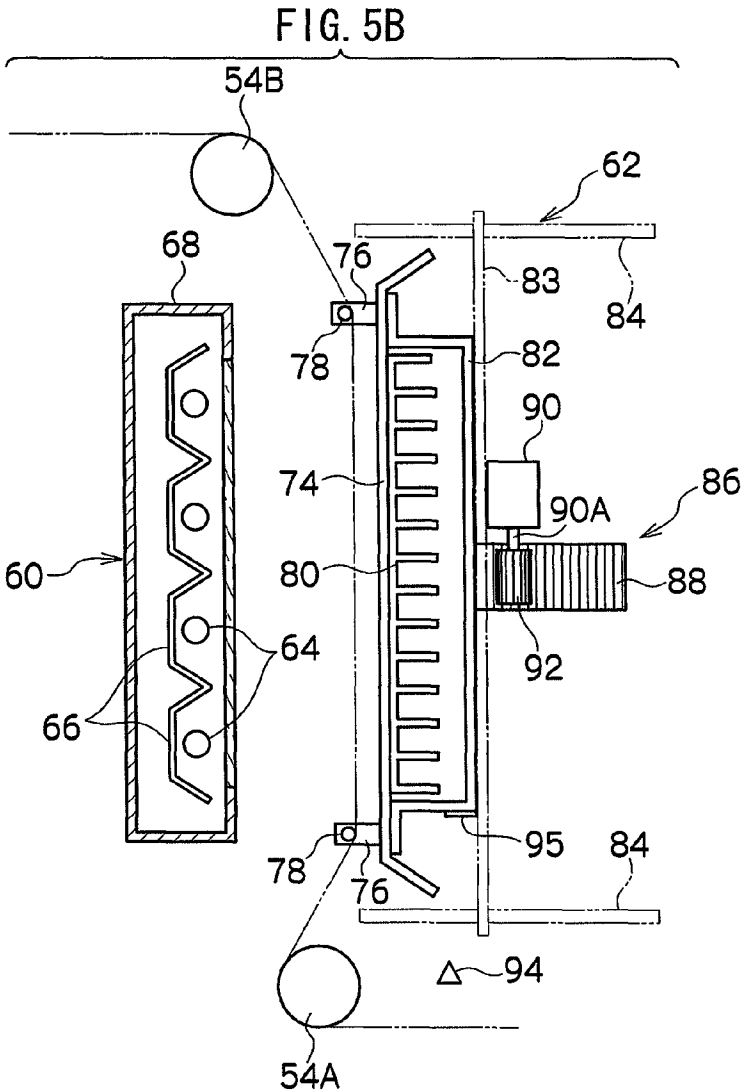
FIGS. 5A and 5B are side diagrams showing the fixing device of the image forming apparatus pertaining to the first exemplary embodiment of the invention, with FIG. 5A being a diagram showing a state where an opposing unit is positioned in the vicinity of a flash fixing unit and FIG. 5B being a diagram showing a state where the opposing unit is withdrawn from the flash fixing unit.
Figure 5A:
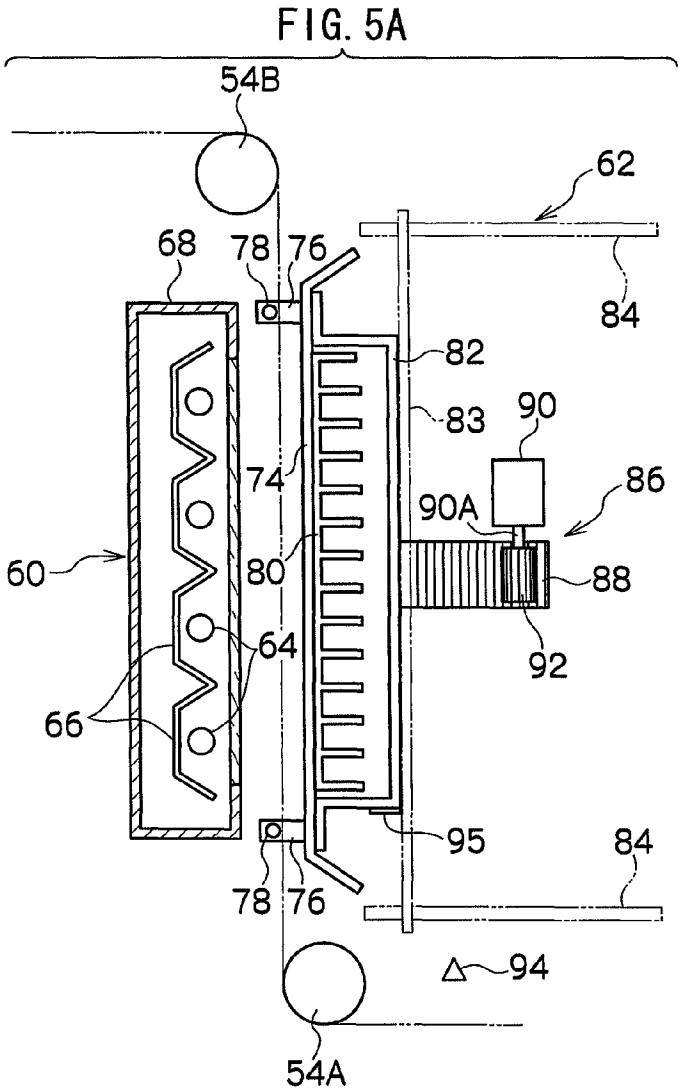

Because of this configuration, the opposing unit 62 is configured to be capable of moving towards and away from the flash fixing unit 60—that is, movable between a position in the vicinity of the flash fixing unit 60 as shown in FIG. 5A and a position (withdrawal (evacuation) position) a predetermined distance away from the flash fixing unit 60 as shown in FIG. 5B.

It will be noted that when the guide plate 74 moves in the direction away from the flash fixing unit 60, the continuous paper P inserted through the clearance formed by the guide plate 74 and the guide members 78 is pulled by the guide members 78 and moves in the direction away from the flash fixing unit 60. In other words, the continuous paper P is pulled by the guide members 78 and is withdrawn (evacuated) from the conveyance path.

Further, an optical sensor 94 is disposed upstream of the opposing unit 62 in the conveyance direction. The optical sensor 94 is configured by a light-emitting element and a light-receiving element that are not shown. When a reflective member 95 disposed on a side wall 82B of the housing 82 moves to a position to which light is emitted from the light-emitting element, the light emitted from the light-emitting element is reflected by the reflective member 95 and received by the light-receiving element.

The optical sensor 94 is connected to the controller 50 (see FIG. 3), and when the optical sensor 94 senses the opposing unit 62 (the reflective member 95 disposed in the housing 82), the driving of the motor 90 is stopped by the controller 50 such that the movement of the opposing unit 62 is stopped.

Moreover, as shown in FIG. 1, a cooling blower 55 is disposed below the flash fixing unit 60 and the opposing unit 62. Air is blown by the cooling blower 55 towards the conveyance surface of the continuous paper P between the flash fixing unit 60 and the opposing unit 62.

It will be noted that although the printer 10 has a configuration where the optical sensor 94 detects that the opposing unit 62 has been withdrawn (evacuated) to a predetermined position (withdrawal position), the printer 10 may also have a configuration where a stepping motor whose rotational amount is controlled by a pulse number sent from the controller 50 is used and the opposing unit 62 is moved a predetermined distance by the rotational driving of the stepping motor whose pulse number has been counted.

Next, printing operation of the printer 10 will be described.

First, the paper conveyance motor 58 is driven and the start-of-image-formation position of the continuous paper P is conveyed by the rotational driving of the main conveyance roll 18 to a toner transfer position of the printing unit 12Y. Then, while the continuous paper P is conveyed, a transfer bias (positive bias) is applied to the transfer roll 24Y and the yellow toner image on the photoconductor drum 22Y is transferred to the continuous paper P.

Similarly, the toner images of the respective colors on the photoconductor drums 22 are sequentially superposed and transferred onto the continuous paper P.

When the leading edge of the region of the unfixed full-color toner image in which the respective color toners of yellow, magenta, cyan and black have been superposed is conveyed to the entrance of an infrared light irradiation region of the flash fixing unit 60, the flash lamps 64 of the flash fixing unit 60 are caused to emit light. Thus, the unfixed full-color toner image on the continuous paper P is heated by the infrared light emitted from the flash lamps 64 when it passes through the infrared light irradiation region of the flash fixing unit 60, melts, congeals after it has passed through the infrared light irradiation region, and is fixed to the continuous paper P. Then, the continuous paper P to which the full-color toner image has been fixed is guided to the discharge rolls 56.

Figure 6:
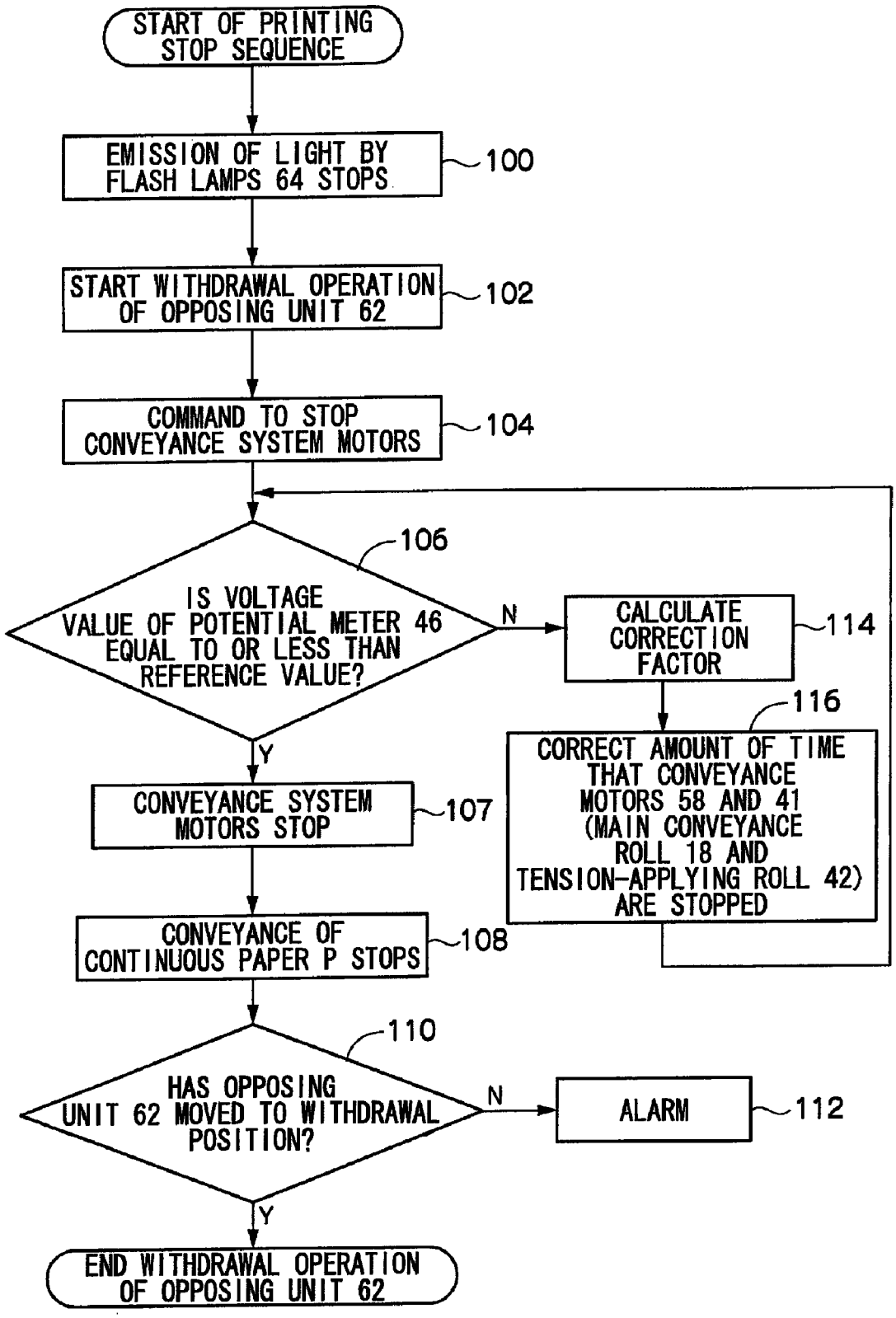
FIG. 6 is a flowchart showing withdrawal operation of the opposing unit of the image forming apparatus pertaining to the first exemplary embodiment of the invention.

Here, withdrawal operation (evacuation operation) of the opposing unit 62 will be described on the basis of the flowchart of FIG. 6.

It will be noted that withdrawal operation of the opposing unit 62 is performed when printing ends or when the continuous paper P becomes jammed during conveyance.

First, when a printing stop sequence is started, in step 100, emission of light by the flash lamps 64 of the flash fixing unit 60 is stopped. Then, in step 102, the driving of the motor 90 is started and the pinion 92 rotates. Thus, the opposing unit 62 begins moving together with the rack 88 towards the withdrawal position. At this time, fluctuation in the tension of the continuous paper P is absorbed by the detection-use roll 44, so in a state where movement of the opposing unit 62 towards the withdrawal position has started, the continuous paper P is pulled to the withdrawal position by the opposing unit 62.

Then, in step 104, a command for the conveyance system motors (the paper conveyance motor 58 connected to the main conveyance roll 18, the paper conveyance motor 41 connected to the back tension-applying roll 42, and the paper conveyance motor 57 connected to the sub-conveyance roll 48) to stop is issued. Thus, the conveyance system motors are stopped after the elapse of a set amount of time, and rotation of the main conveyance roll 18, the back tension-applying roll 42 and the sub-conveyance roll 48 is stopped.

Here, moving to step 106, the amount of slack in the continuous paper P between the main conveyance roll 18 and the sub-conveyance roll 48 is detected from the voltage value of the potential meter 46 attached to the detection-use roll 44. In other words, the voltage value of the potential meter 46 when a predetermined amount of slack is imparted to the continuous paper P between the main conveyance roll 18 and the sub-conveyance roll 48 is used as a reference value, and the voltage value of the potential meter 46 is compared with this reference value.

When it is judged that the voltage value of the potential meter 46 is equal to or less than the reference value, then the sequence moves to step 107 and the conveyance system motors are stopped after the elapse of the set amount of time in accordance with the command for the conveyance system motors to stop that was issued in step 104. Thus, the main conveyance roll 18, the back tension-applying roll 42 and the sub-conveyance roll 48 are stopped, and conveyance of the continuous paper P stops in step 108. In other words, it is judged from the voltage value of the potential meter 46 that slack of an extent where the continuous paper P will not be damaged by withdrawal of the opposing unit 62 is being imparted to the continuous paper P between the main conveyance roll 18 and the sub-conveyance roll 48 (i.e., it is judged whether the slack in the continuous paper P is a predetermined value).

Then, in step 110, it is judged whether or not the opposing unit 62 has been moved to the withdrawal position. In other words, when the opposing unit 62 is detected by the optical sensor 94, it is judged that the opposing unit 62 has been moved to the withdrawal position, and withdrawal operation of the opposing unit 62 ends.

In step 110, when it is judged that the opposing unit 62 has not been moved to the withdrawal position, then the sequence moves to step 112 and the operator is notified of abnormality by a panel (not shown) on the printer 10.

In step 106, when it is judged that the voltage value of the potential meter 46 is greater than the reference value, then the amount of slack in the continuous paper P is smaller than the reference value (the tension is higher than standard), so it is necessary for a predetermined amount of slack to be imparted to the continuous paper P between the main conveyance roll 18 and the conveyance roll 48 by stopping the sub-conveyance roll 48 while the continuous paper P is fed by the main conveyance roll 18 and the back tension-applying roll 42.

Thus, in step 114, a correction factor is calculated by the expression "correction factor=(voltage value−reference value)×amplification factor" from the voltage value and reference value of the potential meter 46 and an amplification factor of the voltage value of the potential meter 46.

Then, in step 116, on the basis of this correction factor, the amount of time that the paper conveyance motors 58 and 41 that drive the main conveyance roll 18 and the back tension-applying roll 42 to rotate are stopped is corrected. In other words, assuming that the set amount of time issued in step 104 is an initial value, then the initial value of the main conveyance roll 18 and the back tension-applying roll 42 is rewritten to a value calculated by "correction time=initial value+correction factor×initial value". In other words, the amount of time that the paper conveyance motors 58 and 41 are stopped is extended.

Thus, the main conveyance roll 18 and the back tension-applying roll 42 are stopped at a later timing than the sub-conveyance roll 48, so slack is imparted to the continuous paper P between the main conveyance roll 18 and the sub-conveyance roll 48.

Then, the sequence returns to step 106, and operation of steps 114 and 116 is repeated until the voltage value of the potential meter 46 becomes equal to or less than the reference value (until the slack in the continuous paper P becomes a predetermined value).

In this manner, when printing ends or when the continuous paper P becomes jammed during conveyance, as shown in FIG. 5B, the opposing unit 62 is caused to be withdrawn in a direction away from the flash fixing unit 60, whereby the continuous paper P held in the opposing unit 62 also is withdrawn in a direction away from the flash fixing unit 60.

Figure 7:
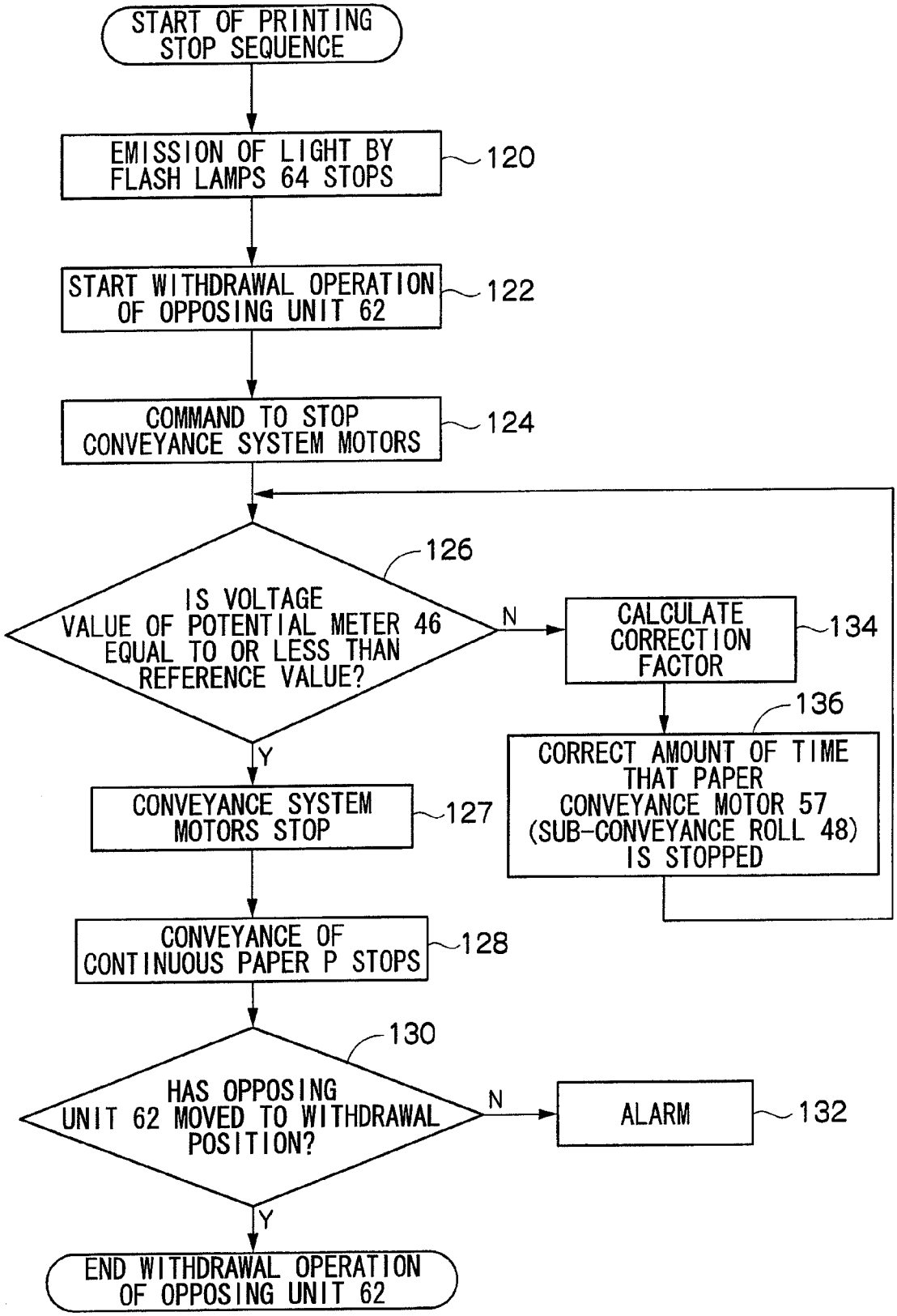
FIG. 7 is a flowchart showing withdrawal operation of the opposing unit of the image forming apparatus pertaining to a second exemplary embodiment of the invention.

Next, withdrawal operation of the opposing unit 62 of the image forming apparatus pertaining to a second exemplary embodiment of the present invention will be described on the basis of the flowchart of FIG. 7.

First, when a printing stop sequence is started, in step 120, emission of light by the flash lamps 64 of the flash fixing unit 60 is stopped. Then, in step 122, the driving of the motor 90 is started and the opposing unit 62 begins to move towards the withdrawal position.

Then, in step 124, a command for the conveyance system motors (the paper conveyance motors 58, 41 and 57) to stop is outputted. Then, the sequence moves to step 126, and the amount of slack in the continuous paper P between the main conveyance roll 18 and the sub-conveyance roll 48 is detected from the voltage value of the potential meter 46 attached to the detection-use roll 44.

Then, when it is judged that the voltage value of the potential meter 46 is equal to or less than the reference value, the sequence moves to step 127 and the conveyance system motors are stopped at a point in time after the elapse of a predetermined amount of time in accordance with the command for the conveyance system motors to stop that was issued in step 124. Thus, the main conveyance roll 18, the back tension-applying roll 42 and the sub-conveyance roll 48 are stopped, and conveyance of the continuous paper P stops. In other words, it is judged from the voltage value of the potential meter 46 that slack of an extent where the continuous paper P will not be damaged by withdrawal of the opposing unit 62 is being imparted to the continuous paper P between the main conveyance roll 18 and the sub-conveyance roll 48.

Then, in step 130, it is judged whether or not the opposing unit 62 has been moved to the withdrawal position. In other words, when the opposing unit 62 is detected by the optical sensor 94, it is judged that the opposing unit 62 has been moved to the withdrawal position, and withdrawal operation of the opposing unit 62 ends.

In step 130, when it is judged that the opposing unit 62 has not been moved to the withdrawal position, then the sequence moves to step 132 and the operator is notified of abnormality by a panel (not shown) on the printer 10.

In step 126, when it is judged that the voltage value of the potential meter 46 is greater than the reference value, then the amount of slack in the continuous paper P is smaller than the reference value (the tension is higher than standard), so it is necessary for a predetermined amount of slack to be imparted to the continuous paper P between the main conveyance roll 18 and the conveyance roll 48 by stopping the sub-conveyance roll 48 while the continuous paper P is fed by the main conveyance roll 18 and the back tension-applying roll 42.

Thus, in step 134, a correction factor is calculated by the expression "correction factor=(voltage value−reference value)×amplification factor" from the voltage value and reference value of the potential meter 46 and an amplification factor of the voltage value of the potential meter 46.

Then, in step 136, on the basis of this correction factor, the amount of time that the paper conveyance motor 57 that drives the sub-conveyance roll 48 to rotate is stopped is corrected. In other words, assuming that the set amount of time issued in step 124 is an initial value, then the initial value of the sub-conveyance roll 48 is rewritten to a value calculated by "correction time=initial value+correction factor×initial value". In other words, the amount of time that the paper conveyance motor 57 is stopped is shortened.

Thus, the sub-conveyance roll 48 is stopped at an earlier timing than the main conveyance roll 18 and the back tension-applying roll 42, so slack is imparted to the continuous paper P between the main conveyance roll 18 and the sub-conveyance roll 48.

Then, the sequence returns to step 126, and operation of steps 134 and 136 is repeated until the voltage value of the potential meter 46 becomes equal to or less than the reference value.

In the present exemplary embodiment, the printer 10 has a configuration where the guide members 78 are disposed on both conveyance direction sides of the guide plate 74 and, when the opposing unit 62 is to be withdrawn, the continuous paper P is withdrawn together with the opposing unit 62 while the continuous paper P is supported at two places (upstream and downstream) in the conveyance direction, but the printer 10 may also have a configuration where just one guide member 78 is disposed.

Further, in the present exemplary embodiment, the printer 10 has a configuration where the opposing unit 62 is caused to be withdrawn in a direction away from the flash fixing unit 60 not only when the printer 10 stops as a result of the continuous paper P becoming jammed but also when operation of the printer 10 is stopped. In other words, the opposing unit 62 is moved in the vicinity of the flash fixing unit 60 at the start of printing.

In the present exemplary embodiment, an image forming apparatus (the printer 10) of the type that sequentially transfers toner images formed on the photoconductor drums 22 to the continuous paper P has been described, but the present invention can also be applied to an image forming apparatus of the type that transfers toner images of photoconductor drums to an intermediate transfer belt and then transfers the image from the intermediate transfer belt to a recording medium (paper).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a fixing device that causes a toner image to be fixed onto a recording medium;

an opposing unit that is disposed opposing the fixing device and forms a conveyance path in between the fixing device, the recording medium being conveyable on the conveyance path;

a holding member for the recording medium that is disposed at the opposing unit and positioned between the recording medium conveyed on the conveyance path and the fixing device; and a withdrawal mechanism that causes the opposing unit to be withdrawn in a direction away from the fixing device, wherein the holding unit is disposed on an opposite side of the conveyance path than the opposing unit.

2. The image forming apparatus of claim 1, wherein the opposing unit is withdrawn at a timing when the fixing device is stopped.

3. The image forming apparatus of claim 1, wherein the holding member includes a roll, and the roll is disposed so as to project from the opposing unit and installed so as to straddle support members positioned at either side of the recording medium.

4. The image forming apparatus of claim 1, further comprising a plurality of conveyance rolls that convey the recording medium, wherein when the withdrawal mechanism causes the opposing unit to be withdrawn, driving of the plurality of conveyance rolls is controlled such that a slack is imparted to the recording medium.

5. The image forming apparatus of claim 4, further comprising a slack detection unit that detects slack in the recording medium, a first conveyance roll among the plurality of conveyance rolls that is disposed upstream of the fixing device in a conveyance direction of the recording medium, and a second conveyance roll among the plurality of conveyance rolls that is disposed downstream of the fixing device in the conveyance direction, wherein a timing that the first conveyance roll is stopped is controlled on the basis of a detection result of the slack detection unit so as to be later than a timing that a second conveyance roll is stopped.

6. The image forming apparatus of claim 4, further comprising a slack detection unit that detects slack in the recording medium, a first conveyance roll among the plurality of conveyance rolls that is disposed upstream of the fixing device in a conveyance direction of the recording medium, and a second conveyance roll among the plurality of conveyance rolls that is disposed downstream of the fixing device in the conveyance direction, wherein a timing that a second conveyance roll is stopped is controlled on the basis of a detection result of the slack detection unit so as to be earlier than a timing that a first conveyance roll is stopped.

7. The image forming apparatus of claim 1, wherein the recording medium includes continuous paper.

8. The image forming apparatus of claim 1, wherein the opposing unit comprises a flat plate that is positioned to be parallel to the conveyance path.

9. The image forming apparatus of claim 8, the opposing unit further comprising radiating fins disposed on a side of the flat plate opposite the fixing device.

10. An image forming apparatus comprising:

a fixing device that is disposed at a side of a recording medium carrying a toner image and fixes the toner image onto the recording medium by radiating a flash light;

a holding member for the recording medium that stretches and supports the recording medium such that the recording medium faces the fixing device; and a withdrawal mechanism that causes the holding member to be withdrawn in a direction away from the fixing device to thereby cause the recording medium to move away from the fixing device, wherein the holding member is configured to be disposed on a side of the recording medium having the toner image.

11. The image forming apparatus of claim 10, wherein the withdrawal mechanism causes the holding member to be withdrawn at a timing when the flash light radiation by the fixing device is stopped.

12. The image forming apparatus of claim 10, wherein the holding member includes a pair of rolls that are respectively positioned in the vicinity of either end of the fixing device in the conveyance direction of the recording medium during a fixing operation and are configured to stretch the recording medium.

13. The image forming apparatus of claim 10, further comprising an opposing unit that is disposed opposing the fixing device and forms a conveyance path in between the fixing device, the recording medium being conveyable on the conveyance path, wherein the holding member is disposed at the opposing unit and is positioned between the recording medium conveyed on the conveyance path and the fixing device.

14. The image forming apparatus of claim 10, further comprising a third conveyance roll that is disposed upstream of the fixing device in the conveyance direction of the recording medium and conveys the recording medium, and a forth conveyance roll that is disposed downstream of the fixing device in the conveyance direction of the recording medium and conveys the recording medium, wherein when the withdrawal mechanism causes the holding member to be withdrawn, driving of the third conveyance roll and the fourth conveyance roll is controlled such that a slack is imparted to the recording medium.

15. The image forming apparatus of claim 14, further comprising a slack detection unit that detects slack in the recording medium, wherein a timing at which the third conveyance roll is stopped and a timing at which the forth conveyance roll is stopped are adjusted on the basis of a detection result of the slack detection unit.

16. The image forming apparatus of claim 10, wherein the recording medium includes continuous paper.

17. The image forming apparatus of claim 13, wherein the opposing unit comprises a flat plate that is positioned to be parallel to the conveyance path.

18. The image forming apparatus of claim 17, the opposing unit further comprising radiating fins disposed on a side of the flat plate opposite the fixing device.

* * * * *